US005615520A

United States Patent [19]

McGuire

[11] Patent Number: 5,615,520

[45] Date of Patent: Apr. 1, 1997

[54] DAMPED ONE-WAY SELF-CLOSING GATE

[75] Inventor: John D. McGuire, Brampton, Canada

[73] Assignee: Brascon Architectural Products Inc., Brampton, Canada

[21] Appl. No.: 436,813

[22] Filed: May 8, 1995

[51] Int. Cl.[6] ..... E05F 1/04

[52] U.S. Cl. ..... 49/237

[58] Field of Search ..... 49/237, 238, 239

[56] References Cited

U.S. PATENT DOCUMENTS

| | | | |
|---|---|---|---|
| 785,550 | 3/1905 | Hess et al. | 49/237 |
| 1,424,913 | 8/1922 | Kahler | 49/237 |
| 4,026,069 | 5/1977 | Bohnett | 49/237 X |
| 4,124,955 | 11/1978 | Kochis | 49/237 |
| 4,285,165 | 8/1981 | Persson | 49/238 X |
| 4,406,034 | 9/1983 | Lindemann | 49/237 X |
| 5,133,152 | 7/1992 | Grancagnolo | 49/239 |

FOREIGN PATENT DOCUMENTS

| | | | |
|---|---|---|---|
| 2408711 | 7/1979 | France | 49/237 |

*Primary Examiner*—Philip C. Kannan
*Attorney, Agent, or Firm*—Eugene J. A. Gierczak

[57] ABSTRACT

A one-way self closing gate such as may be used in retail stores, airports or libraries is provided with an inclined helical ramp mechanism by which opening of the gate also causes lifting of the gate arm relative to the gate base. When released the gate will tend to close itself under the force of gravity. To augment this gravity force a spring is provided which is compressed as the arm rises relative to the base. So that the gate does not close too quickly a screw presses a nylon slug against the turning shaft of the gate. When the gate is closed a force applied to open the gate in the contrary direction to that intended is resisted by abutment of a generously welded internal stop against a generously welded internal upright. In an alternate form this resistance function in the closed position is performed by an adjacent post positioned to intercept the motion of the moving barrier. In all cases the internal mechanism of the gate is enclosed in a housing to prevent injury to children's fingers.

20 Claims, 6 Drawing Sheets

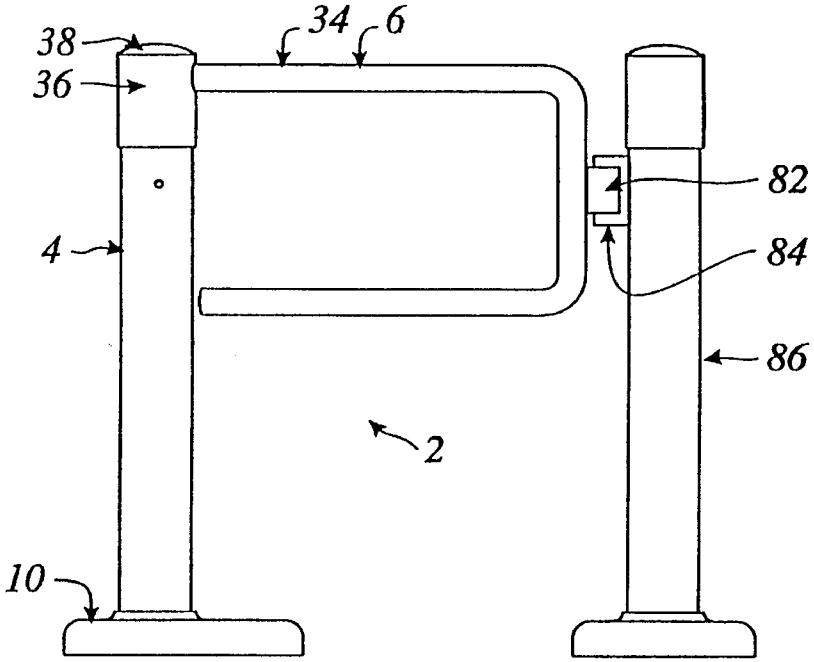
Figure 4a.
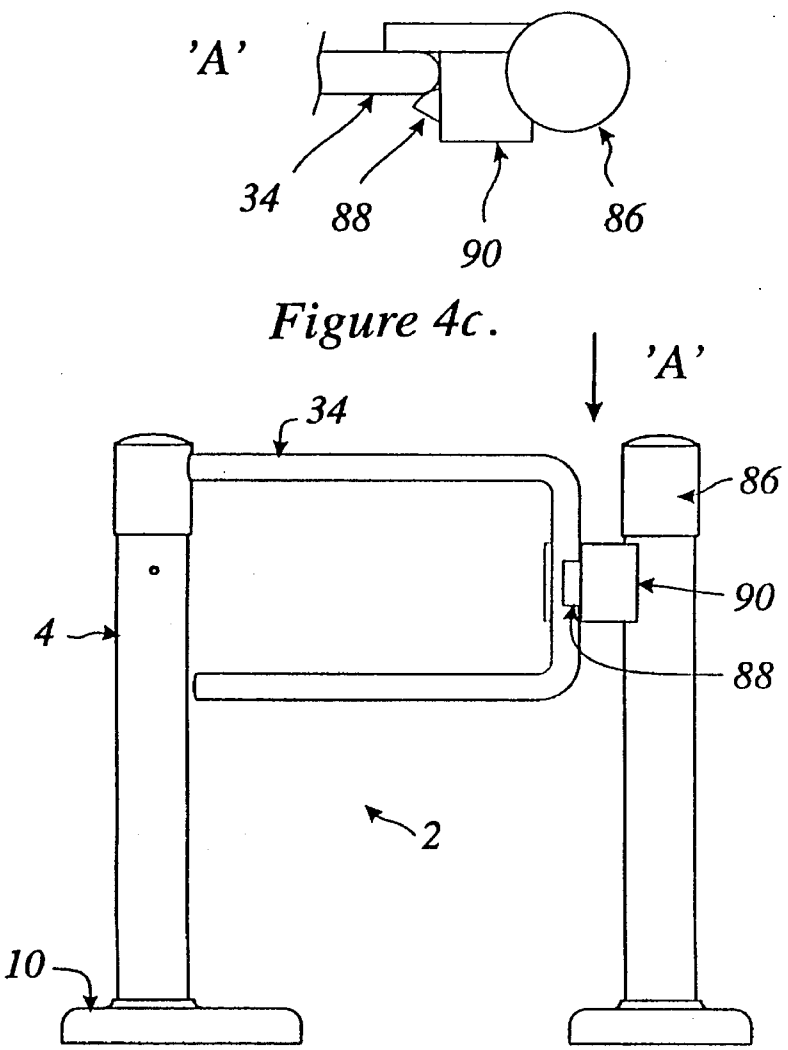
Figure 4b.
Figure 4c.

DAMPED ONE-WAY SELF-CLOSING GATE

FIELD OF THE INVENTION

This invention relates to the field of self-closing gates, and in particular the kind of self-closing gate or barrier found in stores to permit passage in one direction, but not in the other direction. The internal mechanisms of these gates or barriers do not require the use of electrical equipment such as motors or electronic controls.

BACKGROUND ART

There are many earlier examples of self closing gates. In general they use the weight of the barrier and an inclined plane or cam surface interacting with another cam surface or a roller, to force an extended wing member toward a null position. The extended wing member may be a farm gate, a toilet stall door, a kitchen door, or, as here, a one way gate in a store. The profile of the cam surface varies, but the principal remains the same in all cases.

Farm gates are shown, for example, in U.S. Pat. Nos. 381,063 to Ford, 785,550 to Hess & Matthews, and 1,424,913 to Kahler. Ford shows a kind of two-winged butterfly gate that turns continually in one direction. It moves between closed and open positions by means of two long levers which lift the lugs of a connecting bar up over successive detents to permit sliding motion down a subsequent inclined plane. Hess & Matthews show a typical inclined plane arrangement controlled from a distance by means of wires and pulleys. Kahler shows a sprung gate, again controlled by wires and pulleys. The quite complicated mechanism shown has internal cam surfaces and sliding bars and slots to choose between motion to an open position or to a closed position.

Typical washroom door structures are described in U.S. Pat. Nos. 4,124,955 to Kochis, 4,881,353 to Braendel et al., and 5,025,531 to McCarty. All of these are variations on the inclined plane closure whereby pushing a door causes it to lift upward, and gravity pulls the door back to a closed position.

A more interesting door closure mechanism is shown in U.S. Pat. No. 4,406,034 to Lindemann, in which a swinging kitchen door is provided with not only a roller which is pushed up an inclined track as a door is opened, and which rolls backward along that track under the force of gravity on the door, but also with a return spring that is compressed as the door opens to either side, and whose release assists gravity in forcing the swinging door back to its null, or closed, position.

All of these earlier devices have disadvantages when considered for use in one-way gates. First, of course, several of them are swing gates, rather than one-way closures. One-way closures have nonetheless been known generally for many years. Several of the earlier devices, particularly the farm gates, show un-necessary cable and pulley systems for operation from a distance, for example to permit the gate to be opened without dismounting from a car or truck. Several show undesirable exposed mechanisms which would be a safety hazard, particularly in the context of children's fingers, and therefore unsuitable in a store. In many cases gravity alone would not be satisfactory to ensure sufficiently rapid, yet gentle, closing of a gate, particularly as the weight of the gate, and hence its eccentric moment load, increases. There is a dearth of damping devices amongst the earlier gates.

It would be possible to build a functioning gate incorporating two stops into a single cam surface ramp, having integral stops at both upper and lower ends, the stops forming part of the stationary structure of the gate. Such a device would rely upon a roller mounted on a shaft, or an analogous part, to contact the upper and lower stops, and thereby limiting the range of motion of the gate. In that case, however, the shaft of the roller would carry the torque imposed in reverse motion of the gate. This is undesirable since it may result in a very large load being imposed in bending upon the relatively small diameter of a stub shaft, and worse still, at a point of stress concentration due to the geometry of a threaded hole with which the stub shaft mates, and due to the stress concentrations associated with cold formed threaded parts generally. A shaft could easily fail in such circumstances.

There is thus a need for a compact, self-closing gate with hidden mechanism to prevent, for example, finger pinching, a damping means to reduce erratic oscillation of the gate, and an augmented closing force to improve the response of the gate, all provided within a sturdy structure suited to resist opening in the opposite direction to that desired.

SUMMARY OF THE INVENTION

The present invention relates to a one-way gate whose internal mechanical works are concealed within an enclosure, those mechanical works include independent means to perform the three functions of, first, biasing the gate to return to a closed position; second, limiting the range of motion of the gate between a closed position and a fully open stop; and third, providing a damper to retard the motion of the gate.

In one aspect of the present invention there is a one-way self-closing gate movable from a first, closed position to a second, open position and back again, the gate comprising a stator assembly comprising an axis of rotation; a rotor assembly for pivotal motion about that axis of rotation of the stator assembly, the rotor assembly comprising an arm member for obstructing a passageway; one of (a) the stator assembly or (b) the rotor assembly comprising a ramp; the other of (a) the rotor assembly or (b) the stator assembly comprising a cam follower for displaceable engagement of the ramp; the ramp comprising a low end, a high end and a sloped portion therebetween; the ramp and the cam follower co-operating to cause vertical displacement of the rotor assembly relative to the stator assembly when the gate is moved from the first, closed position to the second, open position, the force of gravity biasing the rotor assembly to return downward along the ramp to the first, closed position; a spring captured between the stator assembly and the rotor assembly, the vertical displacement from the first position to the second position displacing the spring to augment the force of gravity biasing the rotor assembly to return to the first position; an adjustable damper for retarding motion of the rotor assembly from the second position to the first position; and an enclosure member for concealing the ramp, the cam follower, the spring and the damper means.

In another aspect of the invention one may additionally find stop means comprising an upright affixed to the one of (a) the stator assembly or (b) the rotor assembly which comprises the ramp; a closed stop and an open stop affixed to the other of (a) the stator assembly or (b) the rotor assembly; the upright comprising a first face and a second face; the first stop disposed to abut the first face in the first, closed position of the gate; the position of the gate in which the second stop abuts the second face defining a fully open position of the gate.

BRIEF DESCRIPTION OF DRAWINGS

FIG. 3 comprises three views, FIGS. 3*a*, 3*b*, and 3*c* of the same cross-section of the internal assembly of the gate of FIGS. 1 and 2 taken along section 'B—B' of FIG. 2.

FIG. 4 comprises 3 views, FIG. 4*a*, 4*b*, and etc. FIG. 4*a* and 4*b* shows two alternate embodiments of the present invention in co-operation with a door post like structure. FIG. 4*c* is a partial top view of FIG. 4*a* along the line "A".

DETAILED DESCRIPTION OF THE BEST MODE FOR CARRYING OUT THE INVENTION

Figure 1:
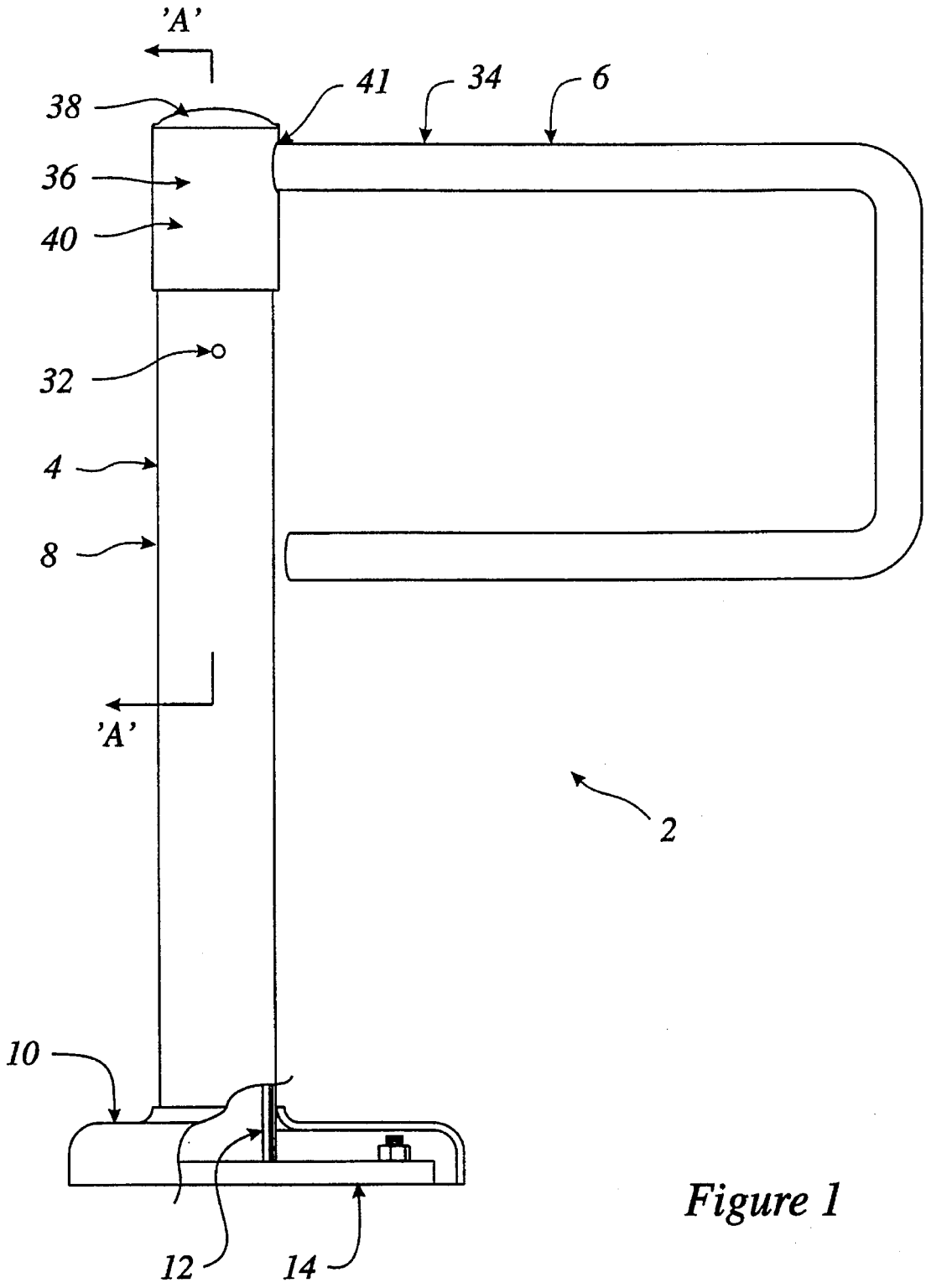
FIG. 1 is a perspective general view of a damped self closing gate according to the present invention.

As shown in FIG. 1 a damped one-way gate is shown generally as 2. A stator assembly is shown generally as 4 and a rotor assembly is generally indicated as 6. An axis of rotation 7 defines the axis of pivotal motion of rotor assembly 6 with respect to stator assembly 4.

Figure 2:
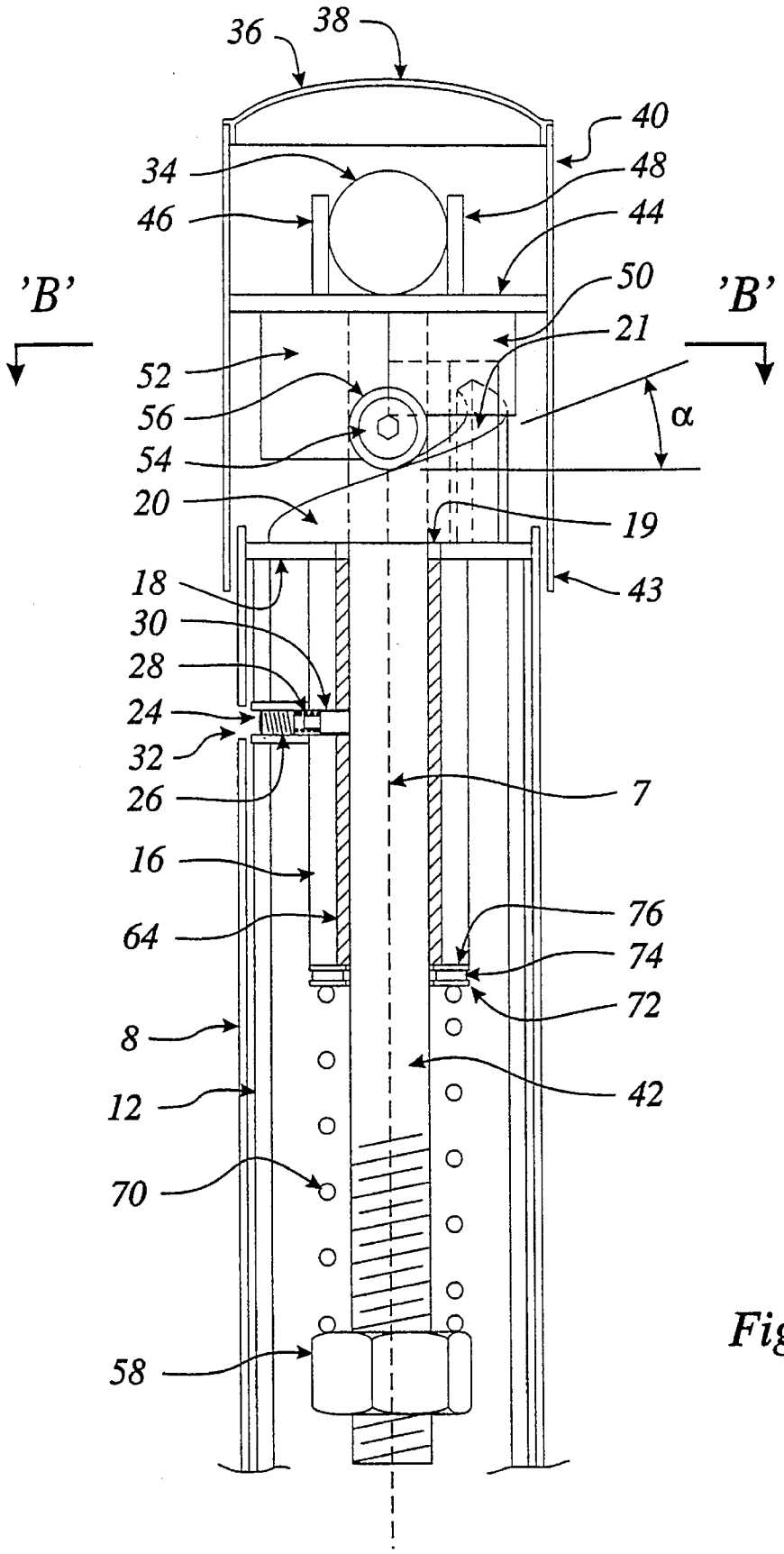
FIG. 2 is a vertical cross-section of the gate of FIG. 1 taken along section 'A—A' indicated in FIG. 1.

Referring to both FIGS. 1 and 2, the stator assembly comprises a chrome outer sleeve 8, a base cover 10, a steel pipe 12, a base plate 14, a main cylinder 16, a lower disk 18, a ramp 20, an upright 22, a threaded hole 24, a pressure set screw 26, a pressure spring 28, a nylon drag 30, and an aperture 32.

The rotor assembly 6 comprises a handle or barrier or arm 34, a shroud 36 comprising a top cap 38 and a top collar 40, a main shaft 42, of suitable size, for example one inch diameter, a top disk 44, two gate arm weld tabs 46 and 48, respectively, two shaft stops, being an upper stop 50 and a lower stop 52, a stub shaft 54, a roller 56 and a nylon insert retaining nut 58.

Steel pipe 12 has a lower end and an upper end. Steel plate 14 is welded perpendicularly to the lower end and has appropriate slots for mating with, typically, studs embedded in the floor of a building. Persons skilled in the art would appreciate that there are a number of ways of fastening a pillar to a floor. Lower disk 18 has an aperture 19 of roughly the same diameter as, or slightly larger diameter than, the internal wall of cylinder 16. Cylinder 16 is welded centrally about aperture 19 and therefore also centrally with respect to lower disk 18. Lower disk 18 acts as a base plate to which ramp 20 is welded. Ramp 20 has a tapered, low end, a high end and a sloped surface intermediate the low and high ends. The sloped surface, or upper face 21 describes somewhat more than 180 degrees of arc of a helix. Ramp 20 also has a flat base, or lower face, not visible in the Figures as it abuts, and is welded to, the base plate, or lower disk 18. Finally, ramp 20 comprises a vertical face 23 adjacent the high end such that the high end of ramp 20 forms the vertex between the sloped surface, or upper face 21 and the vertical face 23. The outer periphery of lower disk 18 is then welded to steel pipe 12. Thus is formed a sturdy socket for rotor assembly 6. In use chrome outer sleeve 8 slides down over steel pipe 12 as does base cover 10 to give a more attractive external appearance. Chrome outer sleeve 8 comprises aperture 32 which is located adjacent threaded hole 24 thereby permitting the introduction of an Allen key, or other suitable device, for adjusting pressure set screw 26 which mates threadably with threaded hole 24 as will be described further below. Vertical face 23 abuts upright 22 whose features will be more fully described below.

In rotor assembly 6 top disk 44 is welded co-axially to an end of, and perpendicular to, main shaft 42. Gate arm weld tabs 46 and 48 are welded to top disk 44 in spaced apart parallel relationship to form a channel suitable for engagement of gate arm 34. Top collar 40 slides down over and is welded to weld tabs 46 and 48. Top collar 40 has an aperture 41 of suitable dimension to admit, and thereafter surround, arm 34. When aperture 41 is aligned with gate arm weld tabs 44 and 46, arm 34 may be inserted through aperture 41, between gate arm weld tabs 46 and 48 and welded into position. Top cap 38 is then installed to mate with top collar 40. Top collar 40 also comprises a depending skirt 43 extending downward sufficiently to overlap outer sleeve 8 under all conditions of normal operation.

Figure 3A:
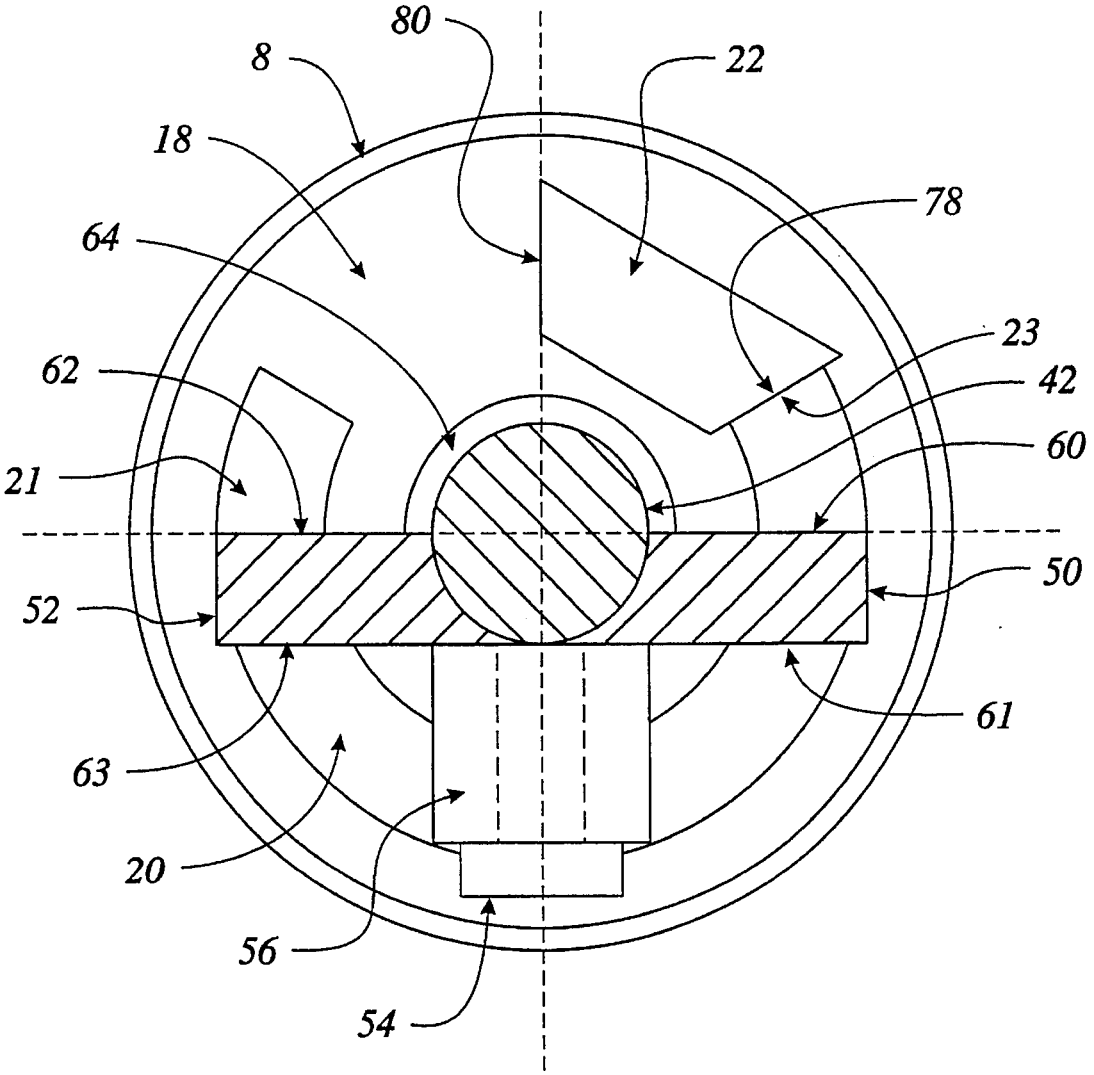
FIG. 3*a* corresponds to the position shown in FIG. 2.

As shown in FIG. 3, upper stop 50 comprises a first face 60 and a second face 61. Lower stop 52 comprises a first face 62 and a second face 63. Each of stops 50 and 52 is welded to both the underside of disc 44 and to main shaft 42. In other words, each stop is held in place by four welds. For example, lower stop 52 is held in place by a first vertical filet along the length of the junction of first face 62 and main shaft 42, a second vertical weldment along the length of the junction of face 63 to main shaft 42, subsequently ground flat to avoid interference with roller 56, a third horizontal filet along the length of the junction of face 62 to disc 44, and a fourth filet along the junction of face 63 with disc 44. Upper stop 50 is welded in place in a similar manner. It would, of course, be possible to machine main shaft 42, disc 44 and stops 50 and 52 from a single monolithic piece of stock, or from a near final dimension casting or forging. In the preferred embodiment the through thickness of stops 50 and 52 is roughly half the diameter of main shaft 42. Thus faces 60 and 62 are substantially coplanar and lying along a diameter of main shaft 42, and faces 61 and 63 are also coplanar, lying in a plane more or less tangential to main shaft 42.

Stub shaft 54 extends radially from main shaft 42 in an orientation substantially perpendicular to faces 60, 61, 62, and 63. Stub shaft 54 is formed from a threaded bolt having a shank and a head with an Allen key recess. It locates in a blind threaded hole (not shown) drilled and tapped perpendicularly into main shaft 42. The head of stub shaft 54 captures cylindrical roller 56.

To assemble the gate 2, the main shaft 42 of rotor assembly 6 may be inserted through cylinder 16 of stator assembly 4. The remaining parts of the gate for assembly are an Ultra High Molecular Weight (UHMV) bushing 64, an engineered compression spring 70, a first flat washer 72, a flat thrust bearing 74, and a second flat washer 76.

UHMV bushing 64 seats within main cylinder 16 in an interference fit, and may be further retained in position with any of a number of suitable adhesives such as are well known to those skilled in the art. It forms a cylinder liner to reduce friction between main shaft 42 and main cylinder 16. Like main cylinder 16, UHMV bushing 64 is of generous length such that an eccentric load applied to arm 34, such as the bending moment applied when an adult sits upon, or swings upon, arm 34 is carried on a relatively large bearing surface, thereby reducing local stress levels and encouraging longer service life. In the preferred embodiment this length is 6 inches. UHMV bushing 64 also comprises a hole in line with aperture 32 and threaded hole 24 to accommodate nylon drag 30.

Second flat washer 76 slides over main shaft 42 to locate against the lower end of cylinder 16, followed by thrust bearing 74, flat washer 72, and finally compression spring 70. These parts are captured by the installation of nylon insert retaining nut 58 on the distal, threaded end of main shaft 42.

Tightening of nut 58 imposes a pre-load in compression spring 70. In the preferred embodiment this pre-load is roughly 10–15 lb. Finally, nylon drag 30 is located at the innermost end of threaded hole 24 such that it abuts main shaft 42. Pressure spring 28 is inserted in threaded hole 24 behind nylon drag 30, and is captured by the installation of adjustable pressure set screw 26. Tightening set screw 26 compresses pressure spring 28 and forces nylon drag 30 more tightly against main shaft 42, thereby increasing the fricative resistance to rotation of shaft 42 within cylinder 16. In some examples of prior art adjacent cam faces wear upon each other. In the preferred embodiment this kind of wear is avoided or reduced by the use of thrust bearing 74 roller 56, and UHMV bushing 64.

Ramp 20 acts as a cam surface, and roller 56 and stub shaft 54 cooperate to act as a cam tillower for movable engagement of ramp 20. The cooperation of ramp 20, stub shaft 54, roller 56, the weight of rotor assembly 6 and gravity constitute a biasing means by which the gate, when released, will tend to return to its closed position. Since this may be insufficiently vigourous, the present gate is also provided with a closure force augmenting means, in this case the compression of spring 70. When rotor assembly 6 is displaced vertically with respect to stator assembly 4 due to the motion of roller 56 along ramp 20 the reaction force in spring 70 increases, augmenting the gravitational return force.

The location of the roller 56 and the ramp 20 may be reversed without altering the function of the device. That is, the ramp 20 may be affixed to rotor assembly 6 and roller 56 mounted to stator assembly 4. Similarly the upper and lower stops 50 and 52 may be interchanged with upright 22. Although spring 70 is shown as a compression spring the configuration of the gate mechanism could easily be altered to use a spring or elastomer in tension.

The spring itself need not necessarily be pre-loaded, although a preload has been found advantageous. The amount of pre-load depends on the rate of closing, or the 'firmness' of the gate desired, and upon the ramp slope chosen. As the angle of slope of the ramp increases the greater the component of spring force which acts along the face, rather than normal to it. For a more steeply sloped ramp a smaller pre-load in spring 70 will yield as large a component of force along upper face 21 of ramp 20 as a larger pre-load would for a less steeply sloped surface. In the preferred embodiment the chosen preload of 10–15 lb. is taken in conjunction with a ramp having a nominal slope of roughly 20 degrees, shown as angle alpha in FIG. 2. Moderate angles in the range of 15 to 40 degrees would be suitable, as would moderate spring pre-loads in the range of 5 to 50 Lb, depending on the angle chosen.

Figure 3B:
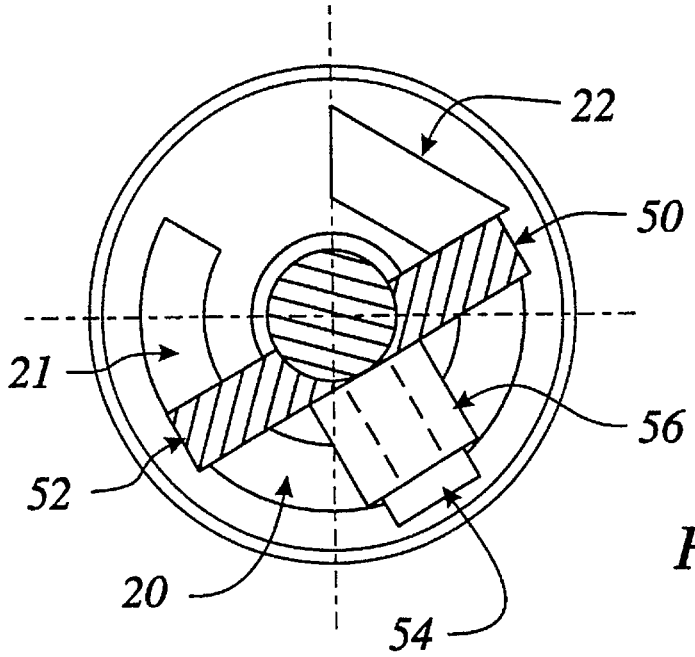
FIG. 3*b* shows the same section of the gate in its fully opened position.
Figure 3C:
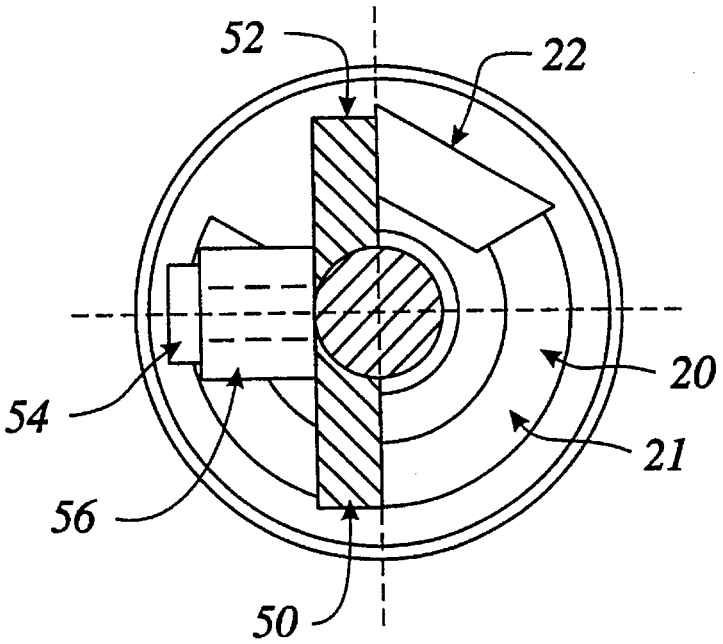
FIG. 3*c* shows the corresponding view in its fully closed position.

FIG. 3 shows a series of cross sections of the internal workings of the gate seen from above, including a fully open position in FIG. 3*b* and a closed position in FIG. 3*c*. Although a right handed gate is shown, the principles of the invention herein would apply equally to a left handed gate.

Upright 22 comprises a first, open stop face 78 and a second, closed stop face 80. In FIG. 3*b* upper stop 50 contacts open stop face 78 of upright 22. Open stop face 78 is machined such that upper stop 50 is intended to meet it in substantially planar contact, as opposed to line or point contact. Note also that upper stop 50 is smaller than lower stop 52 such that it may swing clear of inclined helical ramp 20.

In FIG. 3*c* the gate is in a closed position and lower stop 52 engages second, closed stop face 80 of upright 22. Again it is intended that lower stop 52 contact second face 80 substantially across a full plane of contact, rather than point or line contact.

In the preferred embodiment, lower arm stop 52 is much larger than upper stop 50. When the gate is fully open, as in FIG. 3*b*, there would be no reason for anyone to try to push it past its fully open position, particularly since its range of motion exceeds 90 degrees. In the preferred embodiment the range of motion is roughly 135–140 degrees. Thus the force upper stop 50 has to resist is likely to be relatively small.

However, in the closed position the gate is intended to act as a barrier to reverse passage. As such it may be pushed forcefully by those who wish to pass in the opposite direction. In this position such a load applied to arm 34 is reacted by an opposite normal force in main shaft 42, and an opposed torque transmitted by upright 22 through lower stop 52. The necessary resultant force is multiplied by the ratio of the lever arm over which the turning force is applied, some radius corresponding to the point of arm 34 being pushed, to the effective radius of closed stop face 80. The load is carried through weld tabs 46 and 48, across top disk 44, and into lower stop 52. This load in rotor assembly 6 is transferred to stator assembly 4 across the intended planar contact interface of lower stop face 62 with closed stop face 80 of upright 22. Upright 22 is braced up by ramp 20, and is welded both inside and outside not only to ramp 20, but also directly to lower disk 18. Ramp 20 is itself a relatively stiff thick walled member, and is welded along its lower face, both inside and out, to disk 18. Disk 18 is in turn welded around its full periphery to thick-walled steel pipe 12, which carries the load to its ultimate reaction in the floor mounting.

The preferred embodiment limits the usual force in stub shaft 54 to little more than the weight of rotor assembly 6 plus the force generated in engineered spring 70. The preferred embodiment achieves a relatively compact, enclosed mechanism, yet within that enclosure the reaction force to resist reverse opening of the gate is carried by more robust structure than merely the stub shaft 54 itself. As noted above, lower stop 52 is held by four welds, two vertical, and two horizontal along its vertices, and upright 22 is both welded to lower disk 18 and reinforced by ramp 20. The force transferred across faces 62 and 80 is primarily a normal force with little or no bending component, across an intended plane of contact. Even if an adult sits on arm 34, the vertical load imposed through stub shaft 54 is only increased by the weight of the person in shear. The bending moment is reacted primarily through UHMV bushing 64, rather than roller 56.

The use of nylon drag 30 as a damper prevents the gate from swinging to an abrupt stop, or bouncing back into its closed position. It may be easily adjusted, in effect tuned, to give a desired closing speed or resistance to rapid opening. If it wears out, it can be easily replaced, or another drag inserted directly behind it.

Shroud 36 and outer sleeve 8 co-operate to form an enclosure which conceals the inner workings of the gate. Skirt 43 extends far enough that even when the gate is in its fully open position top collar 40 overlaps sleeve 8 and thereby prevents, for example, children's fingers from being caught between roller 56 and ramp 20 or lower stop 52 and upright 22.

As described, the internal mechanism of the gate has three functions. First there is a biasing means, which performs a return biasing function to urge the gate to return to its closed position under the force of gravity when the gate is released. The biasing means may include an augmenting means, such as the spring 70. Second, there is a damper to retard the motion of the gate. Third the stops and upright perform a motion limiting function, permitting motion from, but not past, a first, closed position, as shown in FIG. 3*c*, and to, but not past a fully open position as shown in FIG. 3*b*. A second, open position may be identical to the fully open position of FIG. 3*b* or may be some position, such as that shown in FIG. 3*a*, intermediate the first, closed position and the fully open position. Each of these three functions is performed independently. An attempt to push the gate past either its closed position or its fully open position will be resisted by the respective stops, not by deforming stub shaft 54 or compressing nylon drag 30. Similarly, the impetus to return to the first, closed position is applied by the biasing means, nothing else. The biasing force is dependent upon displacement, not rate of displacement. Finally, the ability of nylon drag 30 to act as a damper depends only on the speed of the rotor assembly relative to the stator assembly, not the presence of stops or the biasing force generated. Segregation of these functions in the present invention has yielded a robust, tunable device.

The robust, tunable device of the present invention may also be employed in conjunction with conventional gate and post features. For example, arm 34 may be provided with a striker plate 82 for mating with a striker plate 84 which may be mounted to a post 86 or other structural member disposed to obstruct the swinging arc of striker plate 82. Commonly a rubber pad is affixed to one or other of these striker plates to prevent metal on metal contact. Alternatively, arm 34 may swing to engage a spring loaded striker 88 and door latch 90, such as may commonly be found in apartment buildings. Arm 34 displaces the spring loaded striker 88 to seat within the latch 90. Arm 34 may then only be released by depressing striker 88 by some other means, whether by a key, a manual release or an electric release, typically solenoid operated by a doorman or concierge.

Figure 5:
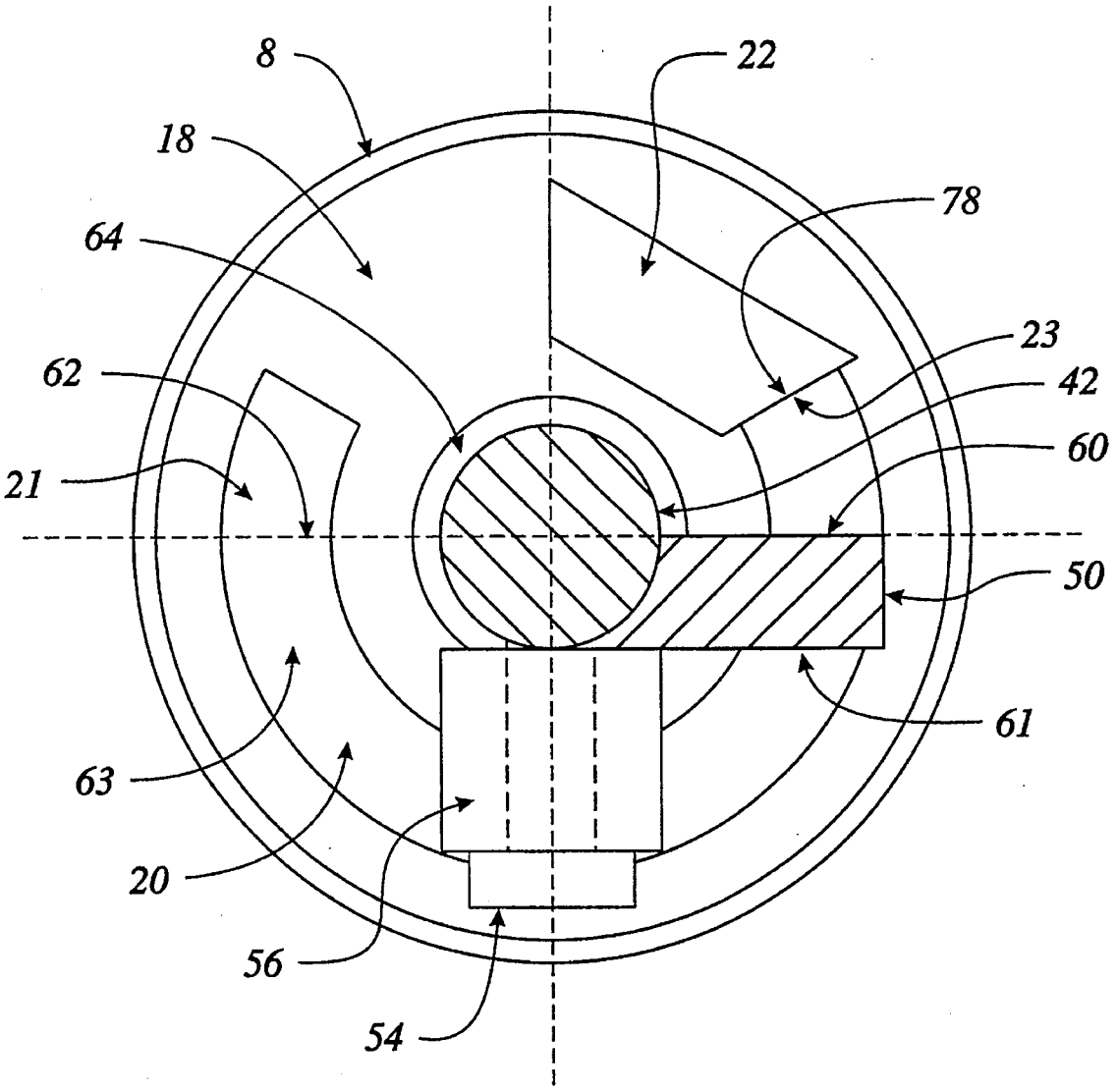
FIG. 5 illustrates the internal structure of the gate of the alternate embodiment of FIG. 4.

In such use the present invention may be used by orienting, that is to say turning, stator assembly 4 such that striker plate 84 or striker 88 is encountered before lower stop 52 contacts upright 22. Alternatively, lower stop 52 may be removed, leaving the configuration shown in FIG. 5, since the torque resisting function it performs is taken up by, for example, post 86. Upper stop 50 remains to limit the opening motion of the gate. As before the three functions of first, limiting gate motion, second, damping that motion, and third, providing biasing means to cause return motion remain segregated. The mechanism continues to be enclosed, and therefore less prone to pinch fingers. The loads imposed to resist excessive opening and closing are not borne by stub shaft 54.

While those skilled in the art will recognize that the foregoing is a description of the preferred embodiment of the present invention, it will be apparent to those skilled in the art that many changes and modifications may be made without departing from the invention in its broader aspects. The appended claims are therefore intended to cover all such changes an modifications as fall within the true spirit and scope of the invention.

I claim:

1. A one-way self-closing gate movable from a first, closed position to a second, open position and back again said gate comprising:

a stator assembly having an axis of rotation;

a rotor assembly for engagement with said stator assembly and pivotal rotation about said axis of rotation biasing means associated with said stator assembly and said rotor assembly to urge said gate to return to said first position from said second position;

augmenting means to assist said biasing means said augmenting means disposed between said stator assembly and said rotor assembly;

a damper associated with said stator assembly to dampen the movement of said gate from said second position to said first position; said rotor assembly is axially displaced relative to said stator assembly, when said rotor assembly is released from said second open position, to said first position.

2. The one-way self-closing gate of claim 1 wherein said biasing means, said augmenting means, and said damper are concealed within an enclosure.

3. The one way self-closing gate of claim 1 wherein said gate comprises stop means for limiting the range of motion of said gate.

4. The one-way self-closing gate of claim 3 wherein said stop means, said biasing means, said augmenting means, and said damper are concealed within an enclosure.

5. The one-way self-closing gate of claim 1 wherein:

said biasing means comprises a ramp affixed to one of (a) said rotor assembly or (b) said stator assembly and a cam follower for movable engagement of said ramp affixed to the other of (a) said rotor assembly or (b) said stator assembly, motion of said gate from said first, closed position to said second, open position causing vertical displacement of said rotor assembly with respect to said stator assembly, gravity biasing said gate to return downward along said ramp to said first position.

6. The one-way self-closing gate of claim 5 wherein:

said augmenting means is a spring captured between said rotor assembly and said stator assembly, said vertical displacement of said rotor assembly with respect to said stator assembly also displacing said spring and increasing the reactive force therein resisting said vertical displacement.

7. The one-way self closing gate of claim 6 wherein said spring is a preloaded compression spring, said pre-load being between 5 and 40 lbs. and the inclination of said ramp is between 10 and 30 degrees.

8. The one-way self closing gate of claim 7 wherein said damper is a nylon drag of said stator assembly biased to press against said rotor assembly.

9. The one-way self closing gate of claim 5 wherein said gate comprises stop means comprising:

an upright affixed to the one of (a) said stator assembly or (b) said rotor assembly;

a closed stop and an open stop affixed to the other of (a) said stator assembly or (b) said rotor assembly;

said upright comprising a first face and a second face;

said closed stop disposed to abut said first face in said first, closed position of said gate;

the position of said gate in which said open stop abuts said second face defining a fully open position of said gate.

10. The one-way self closing gate of claim 5 wherein said gate comprises stop means comprising:

an upright affixed to the one of (a) said stator assembly or (b) said rotor assembly;

an open stop affixed to the other of (a) said stator assembly or (b) said rotor assembly;

said upright comprising a first face and a second face;

the position of said gate in which said open stop abuts said second face defining a fully open position of said gate.

11. The one-way gate of claim 1 wherein said biasing means comprises an inclined camming surface.

12. A one way self closing gate movable from a first, closed position to a second, open position and back again, said gate comprising:

a stator assembly comprising an axis of rotation;

a rotor assembly for pivotal motion about said axis of rotation of said stator assembly, said rotor assembly comprising an arm member for obstructing a passageway;

one of (a) said stator assembly or (b) said rotor assembly comprising a ramp;

the other of (a) said rotor assembly or (b) said stator assembly comprising a cam follower for displaceable engagement of said ramp;

said ramp comprising a low end, a high end and a sloped portion therebetween;

said ramp and said cam follower co-operating to cause vertical displacement of said rotor assembly relative to said stator assembly when said gate is moved from said first, closed position to said second, open position, the force of gravity biasing said rotor assembly to return downward along said ramp to said first, closed position;

a spring captured between said stator assembly and said rotor assembly, said vertical displacement from said first position to said second position displacing said spring to augment the force of gravity biasing said rotor assembly to return to said first position;

an adjustable damper associated with said stator assembly and said rotor assembly for retarding motion of said rotor assembly from said second position to said first position; and an enclosure for concealing said ramp, said cam follower, said spring and said damper;

whereby said rotor assembly is vertically displaced relative to said stator assembly, when said rotor assembly is released from said second open position to said first position, said ramp and said cam follower being aided by said spring and said damper to position said rotor assembly to said first closed position.

13. The one-way self closing gate of claim 12 wherein:

the one of (a) said rotor assembly or (b) said stator assembly which comprises said cam follower also comprises a closed stop and an open stop;

the one of (a) said rotor assembly or (b) said stator assembly which comprises said ramp also comprises an upright;

said upright comprises a first face and a second face;

said closed stop is disposed to abut said first face in said first, closed position; and orientation of said gate to cause said open stop to abut said second face defines a fully open limit position of said gate.

14. The one-way self closing gate of claim 13 wherein:

said cam follower comprises a shaft and a roller disposed thereon for rolling engagement of said ramp.

15. The one-way self closing gate of claim 14 wherein:

the one of (a) said stator assembly or (b) said rotor assembly comprising said ramp comprises a base plate welded thereto concentric with said axis of rotation;

said ramp is a part-helical ramp having an inside wall and an outside wall, a flat base, and a vertical face adjacent said high end;

said flat base is welded to said base plate by a first weldment at the juncture of said inner wall with said base plate and a second weldment at the juncture of said outside wall with said base plate;

said vertical face of said ramp abuts said upright and said upright abut said base plate; and said upright is welded to said ramp by a first weldment at the juncture of said inner wall with said upright and by a second weldment at the juncture of said outer wall with said upright whereby said base plate and said ramp structurally reinforce said upright to resist loads imparted to said upright via said first and second stops.

16. The one-way self closing gate of claim 13 wherein:

said ramp, cam follower and spring co-operate to perform a return biasing function;

said damper performs a motion retarding function;

said stops and upright perform a motion limiting function; and said return biasing, motion retarding, and motion limiting functions are independent of each other.

17. The one-way self closing gate of claim 13 wherein:

the weight of said rotor assembly and the force in said spring are counteracted by a reaction force transferred through said cam follower;

force applied to said arm in said first, closed position tending to push said gate past said closed position is reacted by said closed stop acting against said upright; and force applied to said arm in said fully open position tending to push said gate past said fully open position is reacted by said open stop acting against said upright.

18. A one way self-closing gate movable from a first, closed position to a second, open position and back again, said gate comprising:

a stator assembly comprising an axis of rotation;

a rotor assembly for pivotal motion about said axis of rotation of said stator assembly, said rotor assembly comprising an arm member for obstructing a passageway;

one of (a) said stator assembly or (b) said rotor assembly comprising a ramp;

the other of (a) said rotor assembly or (b) said stator assembly comprising a cam follower for displaceable engagement of said ramp;

said ramp comprising a low end, a high end and a sloped portion therebetween;

said ramp and said cam follower co-operating to cause vertical displacement of said rotor assembly relative to said stator assembly when said gate is moved from said first, closed position to said second, open position, the force of gravity biasing said rotor assembly to return downward along said ramp to said first, closed position;

a spring captured between said stator assembly and said rotor assembly, said vertical displacement from said first position to said second position displacing said spring to augment the force of gravity biasing said rotor assembly to return to said first position;

an adjustable damper associated with said stator assembly and said rotor assembly for retarding motion of said rotor assembly from said second position to said first position; and an enclosure for concealing said ramp, said cam follower, said spring and said damper;

the one of (a) said rotor assembly or (b) said stator assembly which comprises said cam follower also comprising an open stop;

the one of (a) said rotor assembly or (b) said stator assembly which comprises said ramp also comprising an upright;

said upright comprising a radially extending face for contacting said open stop; and whereby rotation of said rotor assembly about said stator assembly to cause said open stop to abut said radially extending face defines a fully open limit position of said gate;

whereby said rotor assembly is vertically displaced relative to said stator assembly, when said rotor assembly is released from said second open position to said first position, said ramp and said cam follower being aided by said spring and said damper to position said rotor assembly to said first closed position.

19. The one-way self closing gate of claim 18 wherein:

said cam follower comprises a shaft and a roller disposed thereon for rolling engagement of said ramp.

20. The one-way self closing gate of claim 18 wherein:

said ramp, cam follower and spring co-operate to perform a return biasing function;

said damper performs a motion retarding function;

said stops and upright perform a motion limiting function; and said return biasing, motion retarding, and motion limiting functions are independent of each other.

* * * * *